United States Patent [19]

Pokhodnya et al.

[11] Patent Number: 4,936,373

[45] Date of Patent: Jun. 26, 1990

[54] CONTINUOUS-CASTING PROCESS FOR PRODUCING HIGH-STRENGTH MAGNESIUM CAST-IRON CASTINGS

[76] Inventors: Igor K. Pokhodnya, ulitsa Chkalova, 4IA, kv. 25.; Vladimir S. Shumikhin, prospekt Bernadskogo, 85, kv. 60.; Ivan G. Razdobarin, prospekt Vernadskogo, 8I, kv. 116.; Anatoly A. Snezhko, Gorovitsa, 8, kv. 27., all of Kiev; Mechislav V. Zhelnis, Partizanu, 36, kv. 30., Kaunas; Vladimir F. Alter, ulitsa Lenina, 88/92, kv. 77., Kiev; Oleg I. Shinsky, ulitsa Dobrokhotova, 3, kv. I7I., Kiev; Boris O. Chernyak, ulitsa Raduzhnaya, 69, kv. 276., Kiev; Nikolai T. Ovcharenko, prospekt Nauki, I03, korpus 3, kv. 53., Kiev, all of U.S.S.R.

[21] Appl. No.: 249,352

[22] Filed: Sep. 23, 1988

[51] Int. Cl.[5] ..... B22D 11/10

[52] U.S. Cl. ..... 164/473

[58] Field of Search ..... 164/473

[56] References Cited

U.S. PATENT DOCUMENTS

| | | | |
|---|---|---|---|
| 3,991,808 | 11/1976 | Nieman et al. | 164/473 |
| 4,220,191 | 9/1980 | Fogarty | 64/473 |
| 4,724,895 | 2/1988 | Mulesa | 164/473 |

FOREIGN PATENT DOCUMENTS

| | | | |
|---|---|---|---|
| 0162468 | 12/1951 | Australia | 164/57.1 |
| 2070936 | 6/1977 | Japan . | |
| 0554063 | 6/1977 | U.S.S.R. | 164/473 |
| 0803703 | 10/1958 | United Kingdom | 164/57.1 |

OTHER PUBLICATIONS

W. A. Potter, L.I.M, Production of S.G. Iron by The Nickel-Magnesium Process, The British Foundryman, Dec. 1957.

R. G. Brown, Raised Killed Steel Yields, The Iron Age, Jul. 4, 1957.

*Primary Examiner*—Richard K. Seidel
*Assistant Examiner*—Rex E. Pelto
*Attorney, Agent, or Firm*—Burgess, Ryan & Wayne

[57] ABSTRACT

The process of the invention comprises feeding molten cast iron into a metal receptacle, continuous feeding of magnesium in a steel sheath into the molten cast iron at a rate ensuring the content of masgnesium in the material of a shaped casting witin the range of about 0.03 to about 0.06 mass %, shaping a casting in a mould, and drawing thereof from the mould.

3 Claims, No Drawings

CONTINUOUS-CASTING PROCESS FOR PRODUCING HIGH-STRENGTH MAGNESIUM CAST-IRON CASTINGS

FIELD OF APPLICATION

The present invention relates to foundry practice and, more particularly, to a continuous-casting process for producing high-strength magnesium cast-iron castings.

The present invention may find application in the production of castings from general-purpose high-strength cast iron in continuous-casting plants.

The present invention may be used with maximum efficiency in the production of castings for making parts meeting enhanced strength and plasticity requirements, for use in hydraulic and pneumatic equipment.

At present it is common practice throughout the world to use magnesium and its alloys for ensuring the formation of globular graphite in the structure of cast iron when producing castings from general-purpose high-strength cast iron.

BACKGROUND OF THE INVENTION

Known in the art is a continuous-casting process for producing high-strength magnesium cast-iron castings, effected by feeding a magnesium cast iron batch-wise into a metal receptacle of a continuous-casting plant under a layer of protecting slag, provided on the surface of a molten cast-iron batch, containing 20–30% of magnesium chloride (SU, A, 944761).

Said process fails to ensure highly stable uniformity of the physico-mechanical properties of the casting in the course of continuous casting because of burning losses of magnesium during the melt holding.

Furthermore, realization of said prior-art process brings about contamination of the shop atmosphere with harmfull substances because of evolution of chlorine from magnesium chloride at high temperatures.

In addition, the above process cannot be automated, since it involves the operations of melting protecting slag, crushing, storing, and metering magnesium additions and slag, which do not lend themselves to automation.

A continuous-casting process for producing high-strength magnesium cast-iron castings is known (X Vsesoyuznaya konferentsiya po vysokoprochnomu chugunu, tezisy dokladov, Akademiya nauk Ukr.SSR, Kiev, lvov, 1977, pp. 110–111), residing in that, with a view to obtaining globular graphite in the structure of cast-iron castings, molten cast iron containing magnesium is poured into the metal receptacle.

During the holding of the magnesium cast iron in the metal receptacle contacting of said cast iron with the atmosphere causes burning losses of magnesium, which proceed in accordance with the reaction:

$$Mg_{vapour} + \tfrac{1}{2}\,O = MgO.$$

As a result, the quantity of magnesium in the melt diminishes continually, this leading to deterioration of the strength characteristics of the metal and to their appreciable non-uniformity along the length of the casting in the course of continuous casting.

Besides, said process leaves out of account changes in the content of magnesium in cast iron (burning losses of magnesium) upon holding cast iron at a high temperature.

Burning losses of magnesium bring down its content and upon attaining a certain minimum content permissible for given conditions (less than 0.03%) graphite crystallizes in a lamellar rather than globular form, that is, the structure of grey iron is obtained.

The strength characteristics of such a cast iron change considerably along the length of the casting (from the properties of high-strength cast iron to those of grey iron).

In addition, this process requires the operations of crushing, storing, and proportioning of magnesium additions into molten cast iron, which cannot be carried out in an automatic mode.

Widely known are methods of desulphurizing cast iron by injecting powdered magnesium into it in a stream of gases (N. A. Voronova. "Desul'furatsiya chuguna magniem", 1980, "Metallurgiya", Moscow, p. 102).

These methods enable the introduction of powdered magnesium into molten cast iron for the formation of globular graphite in the structure of the latter.

These methods, however, cannot be applied in a continuous-casting process for producing high-strength magnesium cast-iron castings, since they require considerable masses of treated cast iron.

To make the continuous-casting process trouble-free, the height of metal in the metal receptacle above the mould is maintained at 300 to 500 mm.

When immersing a tuyere into the melt to such a depth for injecting magnesium into the melt, the coefficient of magnesium utilization by the cast iron melt is very low (less than 15%).

The efficiency of the continuous-casting process of more than 9.5 kg/s requires a high consumption of magnesium and gas, this bringing about splashes of metal from the receptacle and deterioration of the working conditions of the service personnel.

Furthermore, injection of magnesium into molten cast iron involves complicated technological operations.

Also known is a continuous-casting process for producing high-strength magnesium cast-iron castings (SU, A, 544063), residing in a periodic feeding of magnesium cast iron into a metal receptacle, shaping a casting in a mould, and drawing the casting from the mould.

For ensuring stable quality of the material of the casting, the content of magnesium in the cast iron being replenished is increased by 0.01–0.1 mass % compared with the content of magnesium in the cast iron left in the metal receptacle by the moment of replenishing. Magnesium content in the cast iron being replenished is found from the relation:

$$Mg_2 \geqq \frac{\Delta Mg\, t(p_1 + p_2)}{p_2} + Mg_1$$

where $Mg_2$ is the content of magnesium in the cast iron being replenished, mass %;

$\Delta Mg$ are burning losses of magnesium in the metal receptacle per unit of time, %;

t is the time interval between two successive replenishings;

$p_1$ is the mass of cast iron left in the metal receptacle at the time of replenishing;

$p_2$ is the mass of cast iron being replenished;

$Mg_1$ is the content of magnesium in the cast iron left in the metal receptacle by the moment of replenishing, mass %.

But the use of said method in continuous production of castings from high-strength cast iron leads to weakening of the globularizing treatment effect upon overholding of cast iron in the metal receptacle because of burning losses of magnesium. Ultimately, the strength characteristics of the castings become impaired. Depending on the profile of the casting being drawn and on the thickness of its walls, the efficiency of the process varies within a wide range, the time of adding subsequent portions of magnesium cast iron (replenishing time) varies within a wide range accordingly, and may reach 0.5 h and more. During this period the burning losses of magnesium become considerable. Therefore, the properties of cast iron in the castings obtained before and immediately after the replenishing prove to be substantially non-uniform and display appreciable differences.

As a result, it is not feasible to produce castings with a high degree of uniformity of their properties over the length of the products being drawn in the process of continuous casting.

Moreover, treatment of the replenished portions of cast iron with magnesium in the ladle brings about a pyroeffect which leads to pollution of the shop atmosphere with noxious gases and to deterioration of the working conditions of the service personnel.

Magnesium content in the material of the casting, alongside of other parameters, determines the strength properties of the metal. A diminution of the magnesium content in the material of the casting to less than 0.03 mass % leads to a sharp decline in the strength characteristics.

Furthermore, the application of said method requires an operative control over the mass of magnesium cast iron left in the metal receptacle, over the quantity of magnesium in it, over the mass of the cast iron portion to be replenished, as well as over the quantity of magnesium in it, over the crushing and proportioning of magnesium additions. These operations interfere with the automation of the process.

BRIEF DESCRIPTION OF THE INVENTION

The main object of the present invention is to provide such a continuous-casting process for producing high-strength magnesium cast-iron castings, which would make it possible to ensure a high degree of uniformity of the physico-mechanical properties of cast iron all over the length of the casting shaped.

Another object of the present invention is to provide such a continuous-casting process for producing high-strength magnesium cast-iron castings, which would allow improvements in the working conditions of the service personnel.

Still another object of the invention is to provide such a continuous-casting process for producing high-strength magnesium cast-iron castings, which would allow magnesium to be fed into molten cast iron in an automatic mode in accordance with a prescribed program.

These and other objects are accomplished by the provision of a continuous-casting process for producing high-strength magnesium cast-iron castings, comprising feeding molten cast iron into a metal receptacle, continuous feeding into molten cast iron of magnesium in a steel sheath at a rate ensuring the content of magnesium in the material of a shaped casting within the range of from about 0.03 to about 0.06 mass %, shaping a casting in a mould, and drawing the casting from the mould.

It is expedient that the rate of feeding magnesium should be found from the relation:

$$V = \frac{P\,T\,\sqrt{S}}{2 \cdot 10^5\, q}\ m/s,$$

wherein

V is the rate of feeding magnesium into molten cast iron in a metal receptacle, m/s;

P is the average efficiency of the process of drawing castings, kg/s;

q is the mass of magnesium per meter of the sheath, kg/m;

T is the temperature of molten cast iron in the metal receptacle, °K.;

S is the content of sulphur in the starting cast iron, mass %;

$2 \cdot 10^5$ is the proportionality factor accounting for the dimensions of the parameters.

If cast iron is fed batch-wise, it is desirable that the mass of the batch should be so selected as to ensure the content of magnesium in the material of the shaped casting to be within the range of from about 0.03 to about 0.06 mass %.

As a steel sheath it is expedient to use a low-carbon steel ribbon having a thickness of 0.25–0.45 mm.

The process proposed herein makes it possible to produce continuous castings from high-strength cast iron, featuring a higher degree of uniformity of the strength properties throughout the cycle of continuous casting.

This is attained due to the fact that magnesium is fed into molten cast iron continuously, in synchronism with the feeding of starting cast iron; as a result, burning losses of magnesium, occurring in the course of holding the molten cast iron, are compensated for, and assimilation of magnesium by the cast iron within prescribed limits is ensured.

The content of magnesium in the casting and the strength characteristics of the metal (hardness, HB; ultimate strength, $\sigma_B$; relative elongation, $\delta$, %; average degree of magnesium assimilation by the cast iron, remain practically constant at a prescribed level throughout the casting cycle.

The process proposed herein ensures:

- automatic feeding of magnesium into molten cast iron contained in a metal receptacle in accordance with a prescribed program;
- obviation of the operations of crushing and proportioning magnesium-based alloys;
- elimination of the demodification defect;
- keeping the content of magnesium in the material of the casting at a preset level;
- considerable improvements in the working conditions of the service personnel;
- a higher degree of magnesium assimilation by cast iron.

Improvements in the working conditions of the conditions of the service personnel in the process proposed herein are attained through obviation of the operations of crushing and proportioning of the reagents to be introduced, by feeding magnesium automatically, with the possibility of the rate of feeding to be varied within a wide range.

Furthermore, the reaction between magnesium and cast iron is accompanied by slight emission of light and smoke due to the fact that the steel sheath of powdered wire is dissolved mainly in the near-bottom zone of the metal receptacle, a maximal path for the magnesium vapours through the melt being thus ensured.

The presence of the steel sheath precludes interaction of the powdered wire components with oxygen of the atmosphere and assimilation of the modifying elements of the sheath by the melt is thus enhanced.

The steel sheath may be filled not with one, but with several different, thoroughly intermixed modifiers, the result being a combined effect upon treating molten cast iron. Consequently, it becomes possible to obtain a prescribed structure and preset properties of the material of the casting.

The herein-proposed process allows the production of a wide range of high-quality continuously-made castings featuring high service properties (ultimate tensile strength, $\sigma_B$, 450–700 MPa; hardness, HB, 180–240; relative elongation, $\delta$, %, 3–10).

The reagent in the form of powdered magnesium in a steel sheath, employed in the present process for the obtaining of globular graphite in the structure of cast iron, ensures its continuous feeding into the molten cast iron till the residual quantity of magnesium in the metal is ensured to be within the range of from about 0.03 to about 0.06 mass %.

The use of the steel sheath contributes to precluding the contact of magnesium with oxygen of the atmosphere and to maximize assimilation of magnesium by the cast iron.

The use of wire from other materials, e.g. aluminium, copper or their alloys, is not efficient because of a great difference between the melting points of these materials and cast iron. Melting of such sheathes will occur in the upper layers of molten cast iron, and this will contribute to the interaction of magnesium with molten cast iron on the surface thereof, to considerable burning losses of magnesium, to a violent reaction, and to splashes of molten metal from the metal receptacle.

An optimal content of magnesium in the cast iron of the castings should be within the range of from about 0.03 to about 0.06 mass % (depending on the wall thickness of the casting, rate of cooling, and other factors).

In case magnesium content in the castings is less than 0.03 mass %, graphite crystallizes in the lamellar rather than globular form, that is, the structure of grey iron is obtained. The strength characteristics of such cast iron are much inferior.

If the content of magnesium in the castings is greater than 0.06 mass % cracks are developed in the cast iron, which leads to rejects among the castings, the hardness of the castings becomes excessive, and their heat treatment is required.

To ensure magnesium content in the cast iron of the castings within the range of from about 0.03 to about 0.06 mass %, it is expedient that the rate of feeding powdered wire should be found from the relation $$V = \frac{P \cdot T \sqrt{S}}{2 \cdot 10^5 \cdot q} \ m/s,$$

wherein

V is the rate of feeding magnesium into molten cast iron, m/s;

P is the average rate of the process of drawing castings, kg/s;

q is the mass of magnesium per meter of the sheath, kg/m;

T is the temperature of cast iron in the metal receptacle, °K.;

S is the content of sulphur in the starting cast iron, mass %;

$2 \cdot 10^5$ is the proportionality factor accounting for the dimensions of the parameters.

This relation links together the main technological parameters of continuous production of castings from high-strength magnesium cast iron: the rate of feeding magnesium wire (consumption of magnesium), the efficiency of continuous casting, the temperature of treated metal, its composition (in terms of sulphur), and the mass of magnesium per unit length of the wire. An increase of the temperature of treated cast iron, as well as an increase of sulphur content in the cast iron and of the process efficiency, leads to an increase in the consumption of magnesium for the formation of globular graphite in the structure of cast-iron castings.

Magnesium introduced into the molten cast iron if distributed in it in the following manner:

$$q_{Mg} = q_{MgS} + q_{Mgresidual} + q_{MgO}$$

wherein $q_{Mg}$ is the quantity of magnesium introduced into molten cast iron;

$q_{MgS}$ is the quantity of magnesium bound with sulphur and removed therewith from the melt;

$q_{Mgresidual}$ is the quantity of magnesium remaining in the melt; $q_{MgO}$ is the quantity of magnesium spent for the reduction of cast iron.

For the provision of a technological process for producing continuously-made castings from high-strength cast iron, featuring a high degree of uniformity of the strength properties over the length of the casting, it is necessary to establish a regular quantitative distribution of magnesium in the melt.

As the temperature of molten cast iron increases upon introducing magnesium into it, the rate of ascension of magnesium bubbles rises. The probability of their removal from the melt, that is, of burning losses of magnesium, increases.

Numerous experiments made it possible to establish a relationship, according to which magnesium should be fed in an amount of 0.75–2.5 kg per ton of molten cast iron. Such a quantity of magnesium is sufficient for ensuring magnesium content in the material of shaped castings to be within the range of from about 0.03 to about 0.06 mass %, depending on the efficiency of the casting process, on the temperature of molten cast iron, on the content of sulphur therein, and on the mass of magnesium in powdered wire.

At the temperature of cast iron treatment (1500°–1700° K.) and sulphur content in the metal (0.01–0.08 mass %) commonly adopted in foundry practice, an optimal consumption of magnesium for stable obtaining of globular graphite in the structure of cast iron, characteristic of high-strength cast iron, ranges from about 0.75 to about 2.5 kg per ton of the cast iron treated.

The rate of magnesium feeding, found from the relation specified above, allows the obtaining of castings noted for a high uniformity of their strength properties.

With batch-wise feeding of magnesium into the metal receptacle it is desirable that the mass of the batch should be selected so as to ensure the content of magnesium in the casting ranging from about 0.03 to about 0.06 mass %.

Deviation of this condition has a negative effect on the stability of the process, lowers the degree of uniformity of the strength properties of the continuously-produced castings, and impairs their quality.

Such a quantity of magnesium in molten cast iron can be obtained by using the relation:

$$0.06 \geqq \frac{m \cdot Mg}{m + m_1} \geqq 0.03$$

wherein m is the mass of magnesium cast iron in the metal receptacle by the moment of adding starting cast iron into it (at time of replenishing), kg;

Mg is the quantity of magnesium in magnesium cast iron, mass %;

$m_1$ is the mass of grey iron added into the metal receptacle, kg.

As a result, a casting from high-strength cast iron is obtained, with a high degree of uniformity of the strength properties over the length thereof, throughout the casting process.

It is expedient that as a steel sheath for powdered wire use should be made of a low-carbon steel ribbon having a thickness of 0.25–0.45 mm.

As pointed out above, the use of a steel sheath contributes to maximum utilization of magnesium upon feeding thereof into the molten cast iron. This is attained due to the fact that with the rate of feeding powdered wire found from the relation given above, the dissolution of said wire occurs mainly in the near-bottom zone of the metal receptacle.

If the steel sheath for wire has a thickness less than 0.25 mm, its dissolution will occur at an insufficient depth of immersion thereof into the melt, the result being an increase in the burning losses of magnesium and a lower degree of its assimilation by the molten cast iron.

The use of a steel sheath having a thickness more than 45 mm requires for its dissolution in the cast iron an increase of the height of the column of molten metal in the metal receptacle, this adding to the ferrostatic pressure on the casting being shaped in the mould and, possibly, causing a break in the solid crust of the casting at the exit from the mould, i.e., causing an emergency situation.

To preclude such an event, it would be necessary to cut down the efficiency of the casting process, this leading to unnecessary chilling of the metal.

DETAILED DESCRIPTION OF THE INVENTION

The herein-proposed continuous-casting process for producing high-strength magnesium cast-iron castings is carried out in the following manner.

Grey iron of a prescribed composition is prepared in melting furnaces (electric furnaces or cupola furnaces). Then molten cast iron is poured into a magnetodynamic pump or other suitable apparatus which feeds the melt either continuously or batch-wise into a metal receptacle of a plant adapted for continuous casting of cast iron. The mass of the cast iron fed into the metal receptacle depends on the rate of the continuous casting process.

In addition, the process proposed herein may be effected by feeding molten cast iron from the melting furnace into the metal receptacle batch-wise with the aid of a transfer ladle.

To produce a cast-iron casting with the strength characteristics typical for high-strength cast iron, it is necessary that globular graphite be formed in the structure of the metal.

To ensure the formation of globular graphite in the structure of cast iron, powdered magnesium in a steel sheath is fed continuously into it. The rate of feeding magnesium is selected so as to ensure the content of magnesium in the shaped casting within the range of from about 0.03 to about 0.06 mass %.

For ensuring the above-specified content of magnesium in the casting, the rate of feeding powdered wire may be found from the relation $$V = \frac{P \cdot T \sqrt{S}}{2 \cdot 10^5 \cdot q} \ m/s,$$

wherein

P is the average efficiency of the process of drawing castings, kg/s;

q is the mass of magnesium per meter of the sheath, kg/m;

T is the temperature of molten cast iron in the metal receptacle, °K.;

S is the content of sulphur in the starting cast iron, mass %;

$2 \cdot 10^5$ is the proportionality factor accounting for the dimensions of the parameters.

The above relation makes it possible to link together the main technological parameters of the process for continuous production of castings from high-strength magnesium cast iron (the efficiency of the casting process, the temperature of molten cast iron, the content of sulphur in the cast iron, and the mass of magnesium in the powdered wire) and to ensure the content of magnesium in the material of the shaped casting within the range of from about 0.03 to about 0.06 mass %.

As a result, a high degree of the uniformity of the strength properties of the casting is attained throughout the cycle of continuous casting.

When molten cast iron is fed into the metal receptacle batch-wise, it is expedient that the mass of the batch should be selected so as to ensure the content of magnesium in the casting to be within the range of from about 0.03 to about 0.06 mass %.

This condition ensures the formation in the casting of a structure of globular graphite with a high degree of uniformity of the strength characteristics throughout the cycle of continuous casting.

The above-specified quantity of magnesium in the molten cast iron is obtained by using the relation $$0.06 \geqq \frac{m_1 Mg}{m_1 + m_2} \geqq 0.03$$

wherein $m_1$ is the mass of magnesium cast iron in the metal receptacle by the moment of adding starting cast iron into it, kg;

Mg is the content of magnesium in the magnesium cast iron, mass %;

$m_2$ is the mass of grey iron added into the metal receptacle, kg.

As the steel sheath for powdered wire use is made of a low-carbon steel ribbon having a thickness of 0.25–0.45 mm.

This ensures the interaction of magnesium with the molten cast iron in the near-bottom zone of the metal receptacle as the wire is fed into the molten cast iron.

As a result, the path of magnesium bubbles in the melt becomes maximum, their exit into the atmosphere is minimized, and, hence, the burning losses of magnesium are diminished, the working conditions of the service personnel are improved.

The use of a steel sheath having a thickness less than 0.25 mm leads to its dissolution at an insufficient depth of the immersion thereof into the melt, to higher burning losses of magnesium, and to a smaller degree of magnesium assimilation in the molten cast iron.

The use of a steel sheath having a thickness greater than 0.45 mm requires for its dissolution in the cast iron an increase of the height of the column of molten metal in the mould; this adds to the ferrostatic pressure acting on the casting being shaped in the mould and leads to breakage of the solid crust of the casting at the exit from the mould, i.e. to emergency situations.

To preclude such events, it is necessary to diminish the efficiency of the casting process, this leading to unnecessary chilling of the metal.

The technical and economic characteristics of the process proposed herein and of the process disclosed in application Ser. No. 544063, such as the degree of uniformity of the strength properties, the content of magnesium in the material of the castings, the degree of assimilation of magnesium by the cast iron, the quantity of magnesium introduced into the cast iron, are determined in the following manner.

The degree of uniformity of the strength properties is determined by testing samples made from castings in definite periods of time in the course of the casting process.

The degree of magnesium assimilation by the cast iron is determined from the relation $$a = \frac{Mg_{residual} + 0.76(S_1 - S_2)}{Q} 100\%$$

wherein a is the degree of magnesium assimilation by cast iron, %;

0.76 is the ratio of the atomic masses of magnesium and sulphur;

$S_1$ is the content of sulphur in cast iron before introducing magnesium thereinto, mass %;

$S_2$ is the content of sulphur in cast iron after introducing magnesium thereinto, mass %;

Q is the quantity of magnesium introduced into molten cast iron (consumption of magnesium), %;

$Mg_{residual}$ is the quantity of magnesium remaining in molten cast iron, mass %.

The quantity of magnesium introduced into the cast iron (consumption of magnesium) is determined from the relation $$Q = \frac{V \cdot q}{P} 100\%$$

wherein

V is the rate of feeding powdered wire into molten cast iron, m/s;

q is the mass of magnesium per meter of the sheath, kg/m;

P is the rate of drawing, kg/s.

The residual content of magnesium in the castings is determined by subjecting samples made from the castings to chemical or spectral analysis.

Thus, the use of the process proposed herein increases appreciably the degree of uniformity of the strength properties, improves the working conditions of the service personnel, diminishes the quantity of magnesium introduced into the melt, allows the process to be run in an automatic mode according to a preset program.

The process proposed herein does not require considerable expenditures for purchasing additional equipment and materials, it does not require additional floor space, reduces the number of the service personnel, cuts down the consumption of electric power required for melting cast iron, since it does not call for overheating the metal for feeding magnesium thereinto.

For a better understanding of the present invention examples of its specific embodiment are given hereinbelow.

The technical and economic characteristics of the herein-proposed process (the degree of uniformity of the strength properties, the content of magnesium in the castings, the degree of magnesium assimilation by the cast iron, the quantity of magnesium introduced into the cast iron) obtained in the realization thereof according to Examples 1–13 are listed in the Table which follows after said Examples. The same Table lists the data on the strength, hardness, and relative elongation of the castings produced from high-strength cast iron throughout the process of continuous casting.

Furthermore, presented in the same Table for the sake of comparison are similar technical and economic characteristics of the prior-art process disclosed in SU, A, 544063, obtained upon its realization as set forth in Examples 14 and 15, and also the data on the strength, hardness, and relative elongation of castings produced from high-strength cast iron.

EXAMPLE 1

Magnesium powdered wire was fed into a metal receptacle containing molten cast iron of the following composition, mass %: carbon, 3.8; silicon, 2.3; manganese, 9.3; sulphur, 0.05; phosphorus, 0.08; iron, the balance.

The rate of drawing P=1 kg/s.

The temperature of molten cast iron in the metal receptacle T=1500° K.

The thickness of steel sheath of powdered wire is 0.4 mm.

The mass of magnesium per meter of the sheath is 10 g/m (0.01 kg/cm).

The rate of feeding the powdered wire into the molten cast iron, $$V = \frac{1 \cdot 1500 \sqrt{0.05}}{2 \cdot 10^5 \cdot 0.01} = 0.168\ m/s\ (10\ m/mn).$$

Consumption of magnesium:

$$Q = \frac{V \cdot q}{P} 100\% = \frac{0.168 \cdot 0.01}{1} 100\% = 0.168\%$$

or 1.68 kg/t of cast iron.

Concurrently with feeding magnesium into the cast iron melt, ferrosilicon was introduced thereinto in an amount of 0.4% of the mass of the cast iron.

The starting cast iron was fed into the metal receptacle in the form of a continuous stream from a magnetodynamic pump having a capacity of 3000 kg in an amount of 1 kg/s.

The molten cast iron was fed into the magnetodynamic pump from an induction furnace by means of a transfer ladle.

Castings of 100×100 mm cross-section were drawn in two strands.

The modified cast iron in the castings (samples being taken every 0.5 hr of operation) had the following composition, mass %: carbon, 3.5–3.6; silicon, 2.56–2.64; manganese, 0.28–0.30; sulphur, 0.008–0.010; phosphorus, 0.076–0.080; magnesium, 0.04–0.044.

| Strength properties of the cast iron in samples | |
|---|---|
| ultimate tensile strength, $\sigma_B$, | 530–560 MPa |
| hardness, HB, | 185–195 |
| relative elongation, $\delta$, | 4.3–4.7%. |

EXAMPLE 2

Magnesium powdered wire was fed into a metal receptacle containing molten cast iron of the following composition, mass %: carbon, 3.7; silicon, 2.1; manganese, 0.42; sulphur, 0.05; phosphorus, 0.06; iron, the balance.

Drawing rate, P=0.5 kg/s.

Temperature of molten cast iron, T=1650° K.

Thickness of steel sheath of powdered wire, 0.45 mm.

Mass of magnesium per meter of sheath, 10 g/m (0.01 kg/m).

Rate of feeding powdered wire into molten cast iron, $$V = \frac{0.5 \cdot 1650 \sqrt{0.05}}{2 \cdot 10^5 \cdot 0.01} = 0.092\ m/s\ (5.55\ m/mn).$$

Magnesium consumption, $$Q = \frac{V \cdot q}{P} 100\% = \frac{0.092\ 0.01}{0.5} 100\% = 0.184\%$$

or 1.84 kg/t of cast iron.

Concurrently with feeding magnesium into the cast iron melt, ferrosilicon was introduced thereinto in an amount of 0.5% of the mass of the cast iron.

The starting cast iron was fed into the metal receptacle continuously at a rate of 0.5 kg/s from a magnetodynamic pump.

Castings with a cross-section of 100×100 mm were drawn in one strand.

The modified cast iron in the castings (samples being taken every hour of operation) had the following composition, mass %: carbon, 3.45–3.50; silicon, 2.5–2.6; manganese, 0.39–0.41; sulphur, 0.007–0.010; phosphorus, 0.054–0.058; magnesium, 0.038–0.042.

| Strength properties | |
|---|---|
| ultimate tensile strength, $\sigma_B$, | 560–600 MPa |
| hardness, HB, | 210–220 |
| relative elongation, $\delta$, | 5.3–5.6%. |

EXAMPLE 3

Magnesium powdered wire was fed into a metal receptacle containing molten cast iron of the following composition, mass %: carbon, 3.8; silicon, 2.3; manganese, 0.3; sulphur, 0.04; phosphorus, 0.08; iron, the balance.

Drawing rate, P=1 kg/s.

Temperature of molten cast iron in metal receptacle, T=1500° K.

Thickness of steel sheath of powdered wire, 0.4 mm.

Mass of magnesium per meter of sheath, 0.01 kg/m.

Rate of feeding powdered wire into molten cast iron, $$V = \frac{1 \cdot 1500 \sqrt{0.04}}{2 \cdot 10^5 \cdot 0.01} = 0.15\ m/s\ (9\ m/mn).$$

Magnesium consumption, $$Q = \frac{0.15 \cdot 0.01}{1} 100\% = 0.15\%$$

or 1.5 kg/t of cast iron.

Concurrently with feeding magnesium into the cast iron melt, ferrosilicon was introduced thereinto in an amount of 0.5% of the mass of the cast iron being treated.

The starting cast iron was fed into the metal receptacle in a continuous stream at a rate of 1 kg/s.

Castings of 100×100 mm in cross-section were drawn in two strands.

The magnesium cast iron in the castings (samples being taken every 0.5 hr of operation) had the following composition, mass %: carbon, 3.58–3.63; silicon, 2.6–2.65; manganese, 0.28–0.30; sulphur, 0.007–0.010; magnesium, 0.043–0.046; phosphorus, 0.076–0.078.

| Strength properties of cast iron | |
|---|---|
| ultimate tensile strength, $\sigma_B$, | 500–540 MPa |
| hardness, HB, | 180–190 |
| relative elongation, $\delta$, | 4.1–4.5%. |

EXAMPLE 4

Magnesium powdered wire was fed into a metal receptacle containing molten cast iron of the following composition, mass %: carbon, 3.7; silicon, 2.3; manganese, 0.3; copper, 0.5; sulphur, 0.03; phosphorus, 0.06; iron, the balance.

Drawing rate, 1 kg/s.

Temperature of cast iron in metal receptacle, 1650° K.

Mass of magnesium per meter of sheath, 0.01 kg/m.

Thickness of steel sheath of powdered wire, 0.35 mm.

Rate of feeding powdered wire into molten cast iron, $$V = \frac{1 \cdot 1650 \sqrt{0.03}}{2 \cdot 10^5 \cdot 0.01} = 0.142 \text{ m/s (8.5 m/mn).}$$

Magnesium consumption, $$Q = \frac{0.142 \cdot 0.01}{1} 100\% = 0.142\%$$

or 1.42 kg/t of cast iron.

Magnesium was fed into the melt concurrently with ferrosilicon in an amount of 0.4% of the mass of the cast iron.

The starting cast iron was fed into the metal receptacle in a continuous stream at a rate of 1 kg/s.

Castings of 100×100 mm in cross-section were drawn in two strands.

The magnesium cast iron in the castings (samples being taken every 0.5 h of operation) had the following composition, mass %: carbon, 3.57–3.63; silicon, 2.58–2.66; manganese, 0.28–0.3; copper, 0.46–0.48; magnesium, 0.038–0.042; sulphur, 0.008–0.010; phosphorus, 0.056–0.060.

| Strength properties of cast iron | |
|---|---|
| ultimate tensile strength, $\sigma_B$, | 640–680 MPa |
| hardness, HB, | 229–240 |
| relative elongation, δ, | 7.3–7.6%. |

EXAMPLE 5

Magnesium powdered wire was fed into a metal receptacle containing molten cast iron of the following composition, mass %: carbon, 3.9; silicon, 2.15; manganese, 0.5; sulphur, 0.01; phosphorus, 0.06; iron, the balance.

Drawing rate, P=1 kg/s.

Temperature of molten cast iron in metal receptacle, T=1500° K.

Mass of magnesium per meter of sheath, 0.01 kg/m.

Thickness of steel sheath of powdered wire, 0.25 mm.

Rate of feeding powdered wire into molten cast iron, $$V = \frac{1 \cdot 1500 \sqrt{0.01}}{2 \cdot 10^5 \cdot 0.01} = 0.075 \text{ m/s (4.5 m/mn).}$$

Magnesium consumption, $$Q = \frac{0.075 \cdot 0.01}{1} 100\% = 0.075\%$$

or 0.75 kg/t of cast iron.

The starting cast iron was fed into the metal receptacle in a continuous stream at a rate of 1 kg/s.

Concurrently with continuous feeding of magnesium into the melt of cast iron, ferrosilicon was fed continuously thereinto in an amount of 0.4% by mass of the cast iron.

Castings of 100×100 mm in cross-section were drawn in two strands.

The modified cast iron in the castings (samples being taken every 0.5 h throughout the casting process) had the following composition, mass %: carbon, 3.6–3.7; silicon, 2.37–2.43; manganese, 0.47–0.49; sulphur, 0.005–0.007; magnesium, 0.030–0.032; phosphorus, 0.056–0.058.

| Strength properties of cast iron | |
|---|---|
| ultimate tensile strength, $\sigma_B$, | 560–600 MPa |
| hardness, HB, | 215–225 |
| relative elongation, δ, | 5.6–6.0%. |

EXAMPLE 6

Magnesium powdered wire was fed into a metal receptacle containing molten cast iron of the following composition, mass %: carbon, 3.8; silicon, 2.3; manganese, 0.3; sulphur, 0.04; phosphorus, 0.08; iron, the balance.

Drawing rate, P=1 kg/s.

Temperature of molten cast iron in metal receptacle, T=1600° K.

Thickness of steel sheath of powdered wire, 0.45 mm.

Mass of magnesium per meter of sheath, 0.01 kg/m.

Rate of feeding powdered wire into molten cast iron, $$V = \frac{1 \cdot 1600 \sqrt{0.04}}{2 \cdot 10^5 \cdot 0.01} = 0.16 \text{ m/s (9.6 m/mn).}$$

Magnesium consumption, $$Q = \frac{0.16 \cdot 0.01}{1} 100\% = 0.16\%$$

or 1.6 kg/t of cast iron.

The starting cast iron was fed into the metal receptacle in a continuous stream at a rate of 1 kg/s.

Concurrently with continuous feeding of magnesium into the molten cast iron, ferrosilicon was introduced continuously thereinto in an amount of 0.4% by mass of the cast iron.

Castings of 100×100 mm in cross-section were drawn in two strands.

The modified cast iron in the castings (samples being taken from the castings every 0.5 h throughout the casting process) had the following composition, mass %: carbon, 3.5–3.6; silicon, 2.55–2.63; manganese, 0.27–0.29; sulphur, 0.006–0.009; magnesium, 0.040–0.044; phosphorus, 0.074–0.078.

| Strength properties of cast iron | |
|---|---|
| ultimate tensile strength, $\sigma_B$, | 480–520 MPa |
| hardness, HB, | 190–200 |
| relative elongation, δ, | 5.8–6.2%. |

EXAMPLE 7

Magnesium powdered wire was fed into a metal receptacle containing molten cast iron of the following composition, mass %: carbon, 3.8; silicon, 2.3; manganese, 0.3; sulphur, 0.04; phosphorus, 0.08; iron, the balance.

Drawing efficiency, P=1 kg/s.

Temperature of molten cast iron in metal receptacle, 1650° K.

Thickness of steel sheath of powdered wire, 0.4 mm.

Mass of magnesium per meter of sheath, 0.01 kg/m.

Rate of feeding powdered wire into molten cast iron, $$V = \frac{1 \cdot 1650 \sqrt{0.04}}{2 \cdot 10^5 \cdot 0.01} = 0.165 \text{ m/s (9.9 m/mn)}.$$

Magnesium consumption, $$Q = \frac{0.165 \cdot 0.01}{1} 100\% = 0.165\%$$

or 1.65 kg/t of cast iron.

The starting cast iron was fed into the metal receptacle in a continuous stream at a rate of 1 kg/s.

Concurrently with continuous feeding of magnesium into the molten cast iron, ferrosilicon was introduced continuously thereinto in an amount of 0.4% by mass of the cast iron.

Castings of 100×100 mm in cross-section were drawn in two strands.

The modified cast iron in the castings (samples from the castings being taken every 0.5 h throughout the casting process) had the following composition, mass %: carbon, 3.45–3.55; silicon, 2.52–2.58; manganese, 0.26–0.28; sulphur, 0.007–0.010; magnesium, 0.041–0.045; phosphorus, 0.07–0.075.

| Strength properties of cast iron | |
|---|---|
| ultimate tensile strength, $\sigma_B$, | 460–490 MPa |
| hardness, HB, | 180–190 |
| relative elongation, $\delta$, | 5.6–6%. |

EXAMPLE 8

Magnesium powdered wire was fed into a metal receptacle containing molten cast iron of the following composition, mass %: carbon, 4.2; silicon, 2.35; manganese, 0.6; chromium, 0.15; tin, 0.05; sulphur, 0.04; phosphorus, 0.08; iron, the balance.

Drawing rate, P=1 kg/s.

Temperature of cast iron in metal receptacle, 1700° K.

Thickness of steel sheath of powdered wire, 0.4 mm.

Mass of magnesium per meter of sheath, 0.01 kg/cm.

Rate of feeding powdered wire into molten cast iron, $$V = \frac{1 \cdot 1700 \sqrt{0.04}}{2 \cdot 10^5 \cdot 0.01} = 0.17 \text{ m/s (10.2 m/mn)}.$$

Magnesium consumption, $$Q = \frac{0.17 \cdot 0.01}{1} 100\% = 0.17\%$$

or 1.7 kg/t of cast iron.

The starting cast iron was fed into the metal receptacle in a continuous stream at a rate of 1 kg/s.

Concurrently with continuous feeding of magnesium into the molten cast iron, ferrosilicon was introduced continuously thereinto in an amount of 0.4% by mass of the cast iron.

Castings were drawn in two strands.

Cross-section of the castings was 100×100 mm.

The modified cast iron in the castings (samples from the castings being taken every 0.5 hr throughout the casting process) had the following composition, mass %: carbon, 3.85–3.90; silicon, 2.55–2.60; manganese, 0.52–0.55; chromium, 0.12–0.14; tin, 0.04–0.045; sulphur, 0.007–0.01; magnesium, 0.042–0.044; phosphorus, 0.07–0.075.

| Strength properties of cast iron | |
|---|---|
| ultimate tensile strength, $\sigma_B$, | 620–650 MPa |
| hardness, HB, | 230–238 |
| relative elongation, $\delta$, | 7.5–8%. |

EXAMPLE 9

Magnesium powdered wire was fed into a metal receptacle containing cast iron of the following composition, mass %: carbon, 3.8; silicon, 2.2; manganese, 0.4; sulphur, 0.08; phosphorus, 0.077; iron, the balance.

Drawing rate, P=0.4 kg/s.

Temperature of cast iron in metal receptacle, 1600° K.

Thickness of steel sheath of powdered wire, 0.4 mm.

Mass of magnesium per meter of sheath, 0.01 kg/m.

Rate of feeding powdered wire into molten cast iron, $$V = \frac{0.4 \cdot 1600 \sqrt{0.08}}{2 \cdot 10^5 \cdot 0.01} = 0.0865 \text{ m/s (5.2 m/mn)}.$$

Magnesium consumption, $$Q = \frac{0.0865 \cdot 0.01}{0.4} 100\% = 0.216\%$$

or 2.16 kg/t of cast iron.

The starting cast iron is fed into the metal receptacle in a continuous stream at a rate of 0.4 kg/s.

Concurrently with continuous feeding of magnesium into the molten cast iron, ferrosilicon was introduced continuously thereinto in a quantity of 0.4% by mass of the cast iron.

Drawing of castings was carried out in one strand.

Cross-section of the castings was 90×90 mm.

The modified cast iron in the castings (samples from the castings being taken every 0.5 h throughout the casting process) had the following composition, mass %: carbon, 3.55–3.60; silicon, 2.45–2.50; manganese, 0.37–0.39; sulphur, 0.08–0.012; magnesium, 0.034–0.048; phosphorus, 0.072–0.076.

| Strength properties of cast iron | |
|---|---|
| ultimate tensile strength, $\sigma_B$, | 480–520 MPa |
| hardness, HB, | 190–200 |
| relative elongation, $\delta$, | 5.8–6.2%. |

EXAMPLE 10

Magnesium powdered wire was fed into a metal receptacle containing molten cast iron of the following composition, mass %: carbon, 3.8; silicon, 2.2; manganese, 0.4; sulphur, 0.04; phosphorus, 0.077; iron, the balance.

Casting (drawing) efficiency, P=0.5 kg/s.

Temperature of cast iron in metal receptacle, 1600° K.

Thickness of steel sheath of powdered wire, 0.4 mm.

Mass of magnesium per meter of sheath, 0.005 kg/m.

Rate of feeding powdered wire into molten cast iron, $$V = \frac{0.5 \cdot 1600 \sqrt{0.04}}{2 \cdot 10^5 \cdot 0.005} = 0.16 \text{ m/s } (9.6 \text{ m/mn}).$$

Magnesium consumption, $$Q = \frac{0.16\ 0.005}{0.5} 100\% = 0.16\%$$

or 1.6 kg/t of cast iron.

The starting cast iron was fed into the metal receptacle in a continuous stream at a rate of 0.5 kg/s.

Concurrently with continuous feeding of magnesium into the molten cast iron, ferrosilicon was introduced continuously thereinto in an amount of 0.4% by mass of the cast iron.

Castings were drawn in one strand.

Cross-section of the castings was 100×100 mm.

The modified cast iron in the castings (samples from the castings being taken every 0.5 h throughout the casting process) had the following composition, mass %: carbon, 3.54–3.60; silicon, 2.44–2.50; manganese, 0.37–0.39; sulphur, 0.08–0.012; magnesium, 0.039–0.042; phosphorus, 0.072–0.076.

| Strength properties of cast iron | |
|---|---|
| ultimate tensile strength, $\sigma_B$, | 490–530 MPa |
| hardness, HB, | 195–205 |
| relative elongation, δ, | 5.9–6.3%. |

EXAMPLE 11

Magnesium powdered wire was fed into a metal receptacle containing 1500 kg of molten cast iron having the following composition, mass %: carbon, 3.8; silicon, 2.3; manganese, 0.4; sulphur, 0.05; phosphorus, 0.08; iron, the balance.

Casting (drawing) efficiency, P=0.5 kg/s.

Temperature of molten cast iron in metal receptacle, 1600° K.

Thickness of steel sheath of powdered wire, 0.4 mm.

Mass of magnesium per meter of sheath, 0.01 kg/m.

Rate of feeding powdered wire into molten cast iron, $$V = \frac{0.5 \cdot 1600 \sqrt{0.05}}{2 \cdot 10^5 \cdot 0.01} = 0.09 \text{ m/s } (5.4 \text{ m/mn}).$$

Magnesium consumption, $$Q = \frac{0.09 \cdot 0.01}{0.5} 100\% = 0.18\%$$

or 1.8 kg/t of cast iron.

Concurrently with feeding magnesium, ferrosilicon was introduced continuously into the molten cast iron in a quantity of 0.4% by mass of the treated cast iron.

The starting cast iron was fed into the metal receptacle batch-wise, the mass of the one batch being 300 kg, every 10 mn, with the aid of a transfer ladle.

Castings of 100×100 mm in cross-section were drawn in one strand.

The modified cast iron in the castings (samples being taken directly before replenishing grey iron in the metal receptacle and after the replenishing) had the following composition in terms of magnesium content, mass %:

before replenishing, 0.04;

after replenishing, 0.033.

Strength properties of cast iron: ultimate tensile strength, $\sigma_B$, 5.20 MPa (before replenishing) and 450 MPa (immediately after replenishing); hardness, HB, 230 (before replensihing) and 180 (after replenishing); relative elongation, δ, 5.2% (before replenishing) and 4.2% (after replenishing).

EXAMPLE 12

Magnesium powdered wire was fed into a metal receptacle containing 1500 kg of molten cast iron having the following composition, mass %: carbon, 3.8; silicon, 2.3; manganese, 0.4; sulphur, 0.05; phosphorus, 0.08; iron, the balance.

Drawing efficiency, P=0.5 kg/s.

Temperature of molten cast iron in metal receptacle, 1600° K.

Thickness of steel sheath of powdered wire, 0.4 mm.

Mass of magnesium per meter of sheath, 0.01 kg/m.

Rate of feeding powdered wire into molten cast iron, $$V = \frac{0.5 \cdot 1600 \sqrt{0.05}}{2 \cdot 10^5 \cdot 0.01} = 0.09 \text{ m/s } (5.4 \text{ m/mn}).$$

Magnesium consumption, $$Q = \frac{0.09\ 0.01}{0.05} 100\% = 0.18\%$$

or 1.8 kg/t of cast iron.

Concurrently with feeding magnesium, ferrosilicon was introduced continuously into the molten cast iron in an amount of 0.4% by mass of the treated cast iron. Feeding of the starting cast iron into the metal receptacle was effected batch-wise, the batch mass being 360 kg, every 15 mn, with the aid of a transfer ladle.

Castings of 100×100 mm in cross-section were drawn in one strand.

The modified cast iron in the castings (samples being taken directly before replenishing grey iron in the metal receptacle and after the replenishing) had the following composition in terms of magnesium content, mass %:

before replenishing, 0.040.

after replenishing, 0.032.

Strength properties of cast iron: ultimate tensile strength, $\sigma_B$, 520 MPa (before replenishing) and 470 MPA (after the replenishing); hardness, HB, 220 (before replenishing) and 195 (after replenishing); relative elongation, δ, 5.2% (before replenishing) and 4.6% (after replenishing).

EXAMPLE 13

Magnesium powdered wire was fed into a metal receptacle containing 1500 kg of molten cast iron having the following composition, mass %: carbon, 3.8; silicon, 2.3; manganese, 0.4; sulphur, 0.08; phosphorus, 0.08; iron, the balance.

Drawing efficiency, P=0.5 kg/s.

Temperature of molten cast iron in metal receptacle, 1700° K.

Thickness of steel sheath of powdered wire, 0.4 mm.

Mass of magnesium per meter of sheath, 0.01 kg/m.

Rate of feeding powdered wire into molten cast iron, $$V = \frac{0.5 \cdot 1700\sqrt{0.08}}{2 \cdot 10^5 \cdot 0.01} = 0.12 \text{ m/s } (7.2 \text{ m/mn}).$$

Magnesium consumption, $$Q = \frac{0.12 \cdot 0.01}{0.5} 100\% = 0.24\%$$

or 2.4 kg/t of cast iron.

The starting cast iron was fed into the metal receptacle batch-wise, the batch mass being 300 kg, every 10 mn, with the aid of a transfer ladle.

Castings of 100×100 mm in cross-section were drawn in one strand.

The modified cast iron in the castings (samples being taken directly before replenishing grey iron in the metal receptacle and after the replenishing) had the following composition in terms of magnesium content, mass %:

before replenishing, 0.056;

after replenishing, 0.060.

| Strength properties of resulting cast iron | |
|---|---|
| ultimate tensile strength, $\sigma_B$, | 580–620 MPa |
| hardness, HB, | 230–240 |
| relative elongtion, δ, | 3.2–4.6%. |

EXAMPLE 14 (comparative)

Starting cast iron having a composition similar to that specified in Example 2 was treated in accordance with the process disclosed in Inventor's Certificate of the USSR No. 554063. Molten cast iron was treated with a magnesium modifier in a transfer ladle having a capacity of 600 kg. As a magnesium modifier use was made of an alloy comprising, in mass %: magnesium, 10; calcium, 1.8; rare-earth metals, 0.8; silicon, 52; iron, the balance.

The consumption of the modifier was 3% by mass of the cast iron being treated. The temperature of the cast iron before the modification is 1700° K . The modified cast iron was poured into a metal receptacle. The mass of the cast iron in the metal receptacle was 1200 kg. The interval between replenishings is 30 mn.

The mass of the cast iron in the metal receptacle by the moment of replenishing was 600 kg. The mas of replenished magnesium cast iron was 600 kg. The content of magnesium in the replenished cast iron is 0.06 mass %. Burning losses of magnesium during 30 mn of holding the magnesium cast iron in the metal receptacle is 0.045%.

Magnesium content in the cast iron before replenishing, 0.025 mass %.

Magnesium content in the cast iron immediately after replenishing, mass %:

$$\frac{0.020 \cdot 600 + 0.06 \cdot 600}{1200} = 0.04.$$

The modified cast iron in the castings (samples being taken before replenishing the cast iron and immediately after replenishing) had the following strength properties:

| | |
|---|---|
| ultimate tensile strength, $\sigma_B$, MPa | |
| before replenishing | 359 |
| after replenishing | 560 |
| hardness, HB, | |
| before replenishing | 175 |
| after replenishing | 235 |
| relative elongation, δ, % | |
| before replenishing | 9.4 |
| after replenishing | 4.4 |

EXAMPLE 15 (comparative)

Starting cast iron having a composition similar to that specified in Example 4 is treated in accordance with the process disclosed in Inventors's Certificate of the USSR No. 554063.

Molten cast iron was treated with a magnesium modifier in a transfer ladle having a capacity of 1200 kg.

As the magnesium modifier use was made of an alloy comprising, in mass %: magnesium, 10; calcium, 1.8; rare-earth metals, 0.8; silicon, 52; iron, the balance.

The consumption of the modifier was 3.4% by mass of the cast iron treated. The temperature of the cast iron before the modification is 1700° K. The modified cast iron was poured into a metal receptacle. The mass of the cast iron in the metal receptacle is 1800 kg.

The interval between replenishings was 20 mn. The mass of the cast iron in the metal receptacle by the moment of replenishing was 600 kg. The mass of magnesium cast iron to be added is 1200 kg. Magnesium content in the cast iron being replenished was 0.07 mass %. Burning losses of magnesium during 20 minutes of holding the magnesium cast iron in the metal receptacle was 0.03%. Magnesium content in the cast iron before replenishing was 0.04 mass %. Magnesium content in the cast iron immediately after replenishing, mass %:

$$\frac{0.04 \cdot 600 + 0.03 \cdot 1200}{1800} = 0.06.$$

Magenesium content after a successive 20-minute holding, 0.03 mass %.

Magnesium content after a successive replenishing 1200 kg of cast iron with magnesium content of 0.09%, mass %:

$$\frac{0.03 \cdot 600 + 0.07 \cdot 1200}{1800} = 0.067.$$

In the course of two successive replenishings the strength properties of the cast iron changed in the following manner:

| | |
|---|---|
| ultimate tensile strength, $\sigma_B$, | 620–560–520 MPa |
| hardness, HS, | 250–240–200 |
| relative elongation, δ, | 2.1–4.3–5.6%. |

The technical and economic characteristics of the process of the invention and of the prior-art process, presented in the Table illustrate the advantages of the process of the invention.

Thus, for example, in the continuous production of castings from high-strength magnesium cast iron by the process of the invention (Example 2), using the starting cast iron comprising, mass %: carbon, 3.7; silicon, 2.1; manganese, 0.42; sulphur, 0.05; phosphorus, 0.06; iron, the balance, the following advantages are attained over the prior-art process (Example 14).

TABLE

| No. | Characteristics | Process of the invention Examples | | |
|---|---|---|---|---|
| | | 1 | 2 | 3 |
| 1 | 2 | 3 | 4 | 5 |
| 1 | Changes of ultimate tensile strength of high-strength cast iron in the process of drawing castings, $\delta_B$, MPa | 520–560 | 560–600 | 500–540 |
| 2 | Changes of hardness of high-strength cast-iron in the process of drawing casting, HB | 185–195 | 210–220 | 180–190 |
| 3 | Changes of relative elongation of high-strength cast iron in the process of drawing castings, δ, % | 4.3–4.7 | 5.3–5.6 | 4.1–4.5 |
| 4 | Quantity of magnesium introduced into molten cast iron, $Q_{Mg}$, mass % | 0.168 | 0.184 | 0.15 |
| 5 | Changes in content of residual content of magnesium in castings during casting $Mg_{residual}$, masse % | 0.040–0.044 | 0.038–0.042 | 0.042–0.046 |
| 6 | Average degree of magnesium assimilation by cast iron, q, % | 43 | 42 | 41 |

| No | Process of the invention Example | | | | | |
|---|---|---|---|---|---|---|
| | 4 | 5 | 6 | 7 | 8 | 9 |
| 1 | 6 | 7 | 8 | 9 | 10 | 11 |
| 1 | 640–680 | 560–600 | 480–520 | 460–490 | 620–650 | 480–520 |
| 2 | 229–240 | 215–225 | 190–200 | 180–190 | 230–238 | 190–200 |
| 3 | 7.3–7.6 | 5.6–6.0 | 5.8–6.2 | 5.6–6.0 | 7.5–8.0 | 5.8–6.2 |
| 4 | 0.142 | 0.075 | 0.160 | 0.165 | 0.170 | 0.216 |
| 5 | 0.042–0.046 | 0.030–0.032 | 0.040–0.044 | 0.041–0.045 | 0.042–0.044 | 0.030–0.032 |
| 6 | 41 | 41 | 42 | 40 | 39 | 41 |

| No | Process of the invention Example | | | | Prior-art process disclosed in SU, A, 544063 Example | |
|---|---|---|---|---|---|---|
| | 10 | 11 | 12 | 13 | 14 | 15 |
| 1 | 12 | 13 | 14 | 15 | 16 | 17 |
| 1 | 490–530 | 450–520 | 470–520 | 580–620 | 400–560 | 620–560–520 |
| 2 | 195–205 | 180–220 | 195–220 | 230–240 | 175–235 | 250–230–200 |
| 3 | 5.9–6.3 | 4.2–5.2 | 4.6–5.2 | 3.2–3.6 | 2.4–4.4 | 2.1–4.3–5.6 |
| 4 | 0.16 | 0.18 | 0.18 | 0.24 | 0.30 | 0.34 |
| 5 | 0.039–0.042 | 0.033–0.040 | 0.032–0.040 | 0.56–0.06 | 0.025–0.046 | 0.070–0.040–0.057 |
| 6 | 40 | 40 | 40 | 41 | 30 | 25 |

1. An increase in the degree of uniformity of the ultimate tensile strength of castings in the course of the casting process from 160 MPa to 40 MPa, i.e. 4-fold.

2. An increase in the degree of uniformity of the hardness of castings in the course of the casting process from 60 HB to 10 HB, i.e. 6-fold.

3. An increase in the degree of uniformity of the relative elongation of the castings in the course of the casting process from 2.0% to 0.3%, i.e. 6.6-fold.

4. An increase in the degree of uniformity of magnesium content in the castings from 0.021 mass % to 0.004 mass %, i.e. 5-fold.

5. A reduction of the quantity of magnesium fed into the molten cast iron from 0.30 mass % to 0.184 mass %, i.e. by the factor of 1.63.

In addition to the advantages stated above, the present process allows the feeding of magnesium into molten cast iron to be conducted in an automatic mode in accordance with a preset program, the provision of appreciable improvements in the working conditions of the service personnel, as well as obviating the operations of crushing and metering the reagents to be introduced.

In continuous production of castings from high-strength magnesium cast iron on the basis of the starting cast iron comprising, mass percent; carbon, 3.7; silicon, 2.3; manganese, 0.3; copper, 0.5; sulphur, 0.03; phosphorus, 0.06; iron, the balance, by the process of the invention (Example 4), the following advantages are attained over the prior-art process (Example 15).

1. An increase in the degree of uniformity of the ultimate tensile strength of castings in the course of the casting process from 100 MPa to 40 MPa, i.e. 2.5-fold.

2. An increase in the degree of uniformity of the hardness of castings in the course of the casting process from 50 HB to 10 HB, i.e. 5-fold.

3. An increase in the degree of uniformity of the relative elongation of castings in the course of the casting process from 3.5 to 0.3%, i.e. 11-fold.

4. An increase in the degree of uniformity of magnesium content in castings from 0.013 mass % to 0.004 mass %, i.e. 3.25-fold.

5. A reduction of the quantity of magnesium fed into molten cast iron from 0.340 mass % to 0.142 mass %, i.e. by the factor of 2.40.

In addition to the above-stated advantages the present process ensures:

automatic feeding of magnesium into molten cast iron in accordance with a prescribed program;

obviation of the operations of crushing and proportioning of magnesium-based alloys;

ruling out of the demodification effect;

maintaining of magnesium content in castings at a prescribed level;

appreciable improvements in the working conditions of the service personnel;

an enhancement of the degree of magnesium assimilation by cast iron.

The present invention may be used in foundry practice in the production of castings from high-strength general-purpose cast iron on continuous-casting plants for making parts of hydraulic and pneumatic equipment meeting strict requirements as to the strength and plasticity characteristics thereof.

The use of the present process for continuous production of castings from high-strength magnesium cast iron provides a many-fold increase in the ultimate tensile strength of the castings, in the degree of uniformity of the hardness of the castings, and in the relative elongation thereof. Moreover, the process of the invention makes it possible to increase several times the degree of uniformity of magnesium in the castings and to diminish the quantity thereof to be fed into molten cast iron.

We claim:

1. A continuous-casting process for producing high-strength magnesium cast-iron castings, comprising the steps of:

feeding molten cast iron into a metal receptacle;

continuously feeding magnesium in a steel sheath into said molten cast iron at a rate which ensures the presence of from about 0.03 to about 0.06 weight percent of said magnesium in the material of a shaped casting; and wherein said rate of feeding magnesium is found from the relation $$V = \frac{P \cdot T\sqrt{S}}{2 \cdot 10^5 \cdot q}, \ m/s,$$

wherein

P is the average efficiency of the process of drawing castings, kg/s;

q is the mass of magnesium per meter of the sheath, kg/m;

T is the temperature of molten cast iron in the metal receptacle, °K.;

S is the content of sulphur in the starting cast iron, mass %;

$2 \cdot 10^5$ is the proportionality factor accounting the dimensions of the parameters;

shaping a casting in a mold; and drawing said casting from said mold.

2. A continuous-casting process for producing high-strength magnesium cast-iron castings according to claim 1, wherein said feeding of the molten cast iron is carried out batch-wise;

the weight of each batch is selected so as to ensure the content of magnesium in the material of the shaped casting to be within the range of from about 0.03 to about 0.06 weight %.

3. A process according to claim 1, wherein said steel sheath comprises a low-carbon steel ribbon having a thickness of from about 0.25 to about 0.45 mm.

* * * * *